US007466330B2

(12) United States Patent
Kim

(10) Patent No.: US 7,466,330 B2
(45) Date of Patent: Dec. 16, 2008

(54) PRINT HEAD ASSEMBLY AND IMAGE FORMING APPARATUS HAVING THE SAME

(75) Inventor: Sin-ae Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 148 days.

(21) Appl. No.: 11/371,013

(22) Filed: Mar. 9, 2006

(65) Prior Publication Data

US 2006/0284964 A1 Dec. 21, 2006

(30) Foreign Application Priority Data

Jun. 17, 2005 (KR) ..... 10-2005-0052258

(51) Int. Cl.
*B41J 2/32* (2006.01)

(52) U.S. Cl. ..... 347/197

(58) Field of Classification Search ..... 347/197, 347/198, 214, 220, 222; 400/120.16, 120.17, 400/208, 691, 692, 693
See application file for complete search history.

(56) References Cited

U.S. PATENT DOCUMENTS 6,068,415 A * 5/2000 Smolenski ..... 400/120.16
6,428,227 B2 * 8/2002 Petteruti et al. ..... 400/691
6,604,876 B2 * 8/2003 Bryant et al. ..... 400/208

FOREIGN PATENT DOCUMENTS

| | | |
|---|---|---|
| JP | 08-039840 | 2/1996 |
| JP | 10-202970 | 8/1998 |
| JP | 2000-330306 | 11/2000 |
| JP | 2001-180070 | 7/2001 |
| JP | 2004-034323 | 2/2004 |
| JP | 2004-216561 | 8/2004 |

* cited by examiner

*Primary Examiner*—K. Feggins
(74) *Attorney, Agent, or Firm*—Roylance, Abrams, Berdo & Goodman, L.L.P.

(57) ABSTRACT

Provided is a print head assembly capable of preventing paper jam. The print head assembly has a print head for forming an image on a printing medium and is provided with a hinge axis. The print head assembly further includes a supporting unit for rotatably supporting the print head about the hinge axis and movably supporting the hinge axis. Also, the print head assembly provides a driving unit for driving the print head.

10 Claims, 8 Drawing Sheets

PRINT HEAD ASSEMBLY AND IMAGE FORMING APPARATUS HAVING THE SAME

CROSS-REFERENCE TO RELATED APPLICATION

This application claims benefit under 35 U.S.C. §119(a) of Korean Patent Application No. 2005-52258, filed Jun. 17, 2005, in the Korean Intellectual Property Office, the entire disclosure of which is hereby incorporated by reference.

BACKGROUND OF THE INVENTION

1. Field of the Invention

The present invention relates to an image forming apparatus. More particularly, the present invention relates to an image forming apparatus having a print head which is movable so as to prevent a paper jam.

2. Description of the Related Art

An image forming apparatus such as a photo printer employs a thermal transfer method for forming an image. In a thermal transfer method heat is applied to a printing medium such as a thermosensitive paper in order to form an image. An exemplary conventional thermal transfer type image forming apparatus is shown in FIG. 1.

Figure 1:
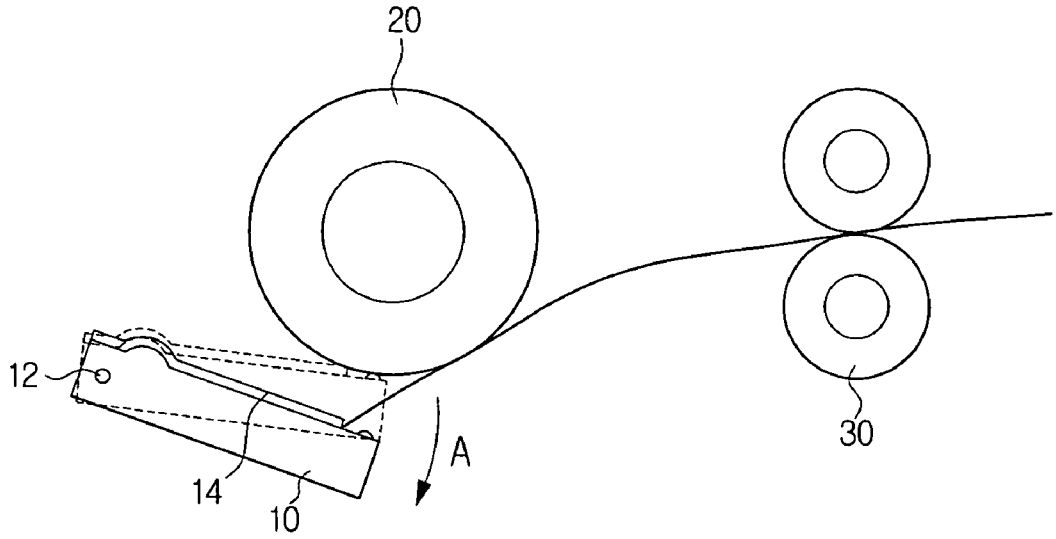
FIG. 1 (PRIOR ART)

Referring to FIG. 1, a conventional thermal transfer type image forming apparatus comprises a print head 10 having a heater assembly. The heater assembly includes a plurality of heaters (not shown) arranged at predetermined intervals in a row. The conventional thermal transfer type image forming apparatus further includes a platen roller 20 for supporting the printing medium when the print head 10 heats the printing medium and forms an image. The print head 10 is provided with a plurality of driving chips that each control a respective group of heaters from the plurality of heaters. The print head 10 is further provided with a protective coating layer to cover and protect the plurality of driving chips.

The print head 10, prior to picking up the printing medium, is situated to be close to the platen roller 20, as illustrated with a dotted line in FIG. I. When a printing signal is transmitted from a controlling part (not shown), a pickup roller (not shown) picks up the printing medium. The printing medium is then moved by a feed roller 30 so as to be positioned between the platen roller 20 and the print head 10. The print head 10 rotates about a hinge axis 12 in a direction 'A' so as to be spaced apart from the platen roller 20 thus allowing the printing medium to enter.

Recesses are formed between respective driving chips and the protective layer. Due to the recesses, the printing medium contacting the protective layer develops vertical stripes that correlate to the recesses. The vertical stripes occur as a result of the heat generated from the driving chips. A cover 14 covering the protective layer is formed to prevent such vertical stripes from being created. The heater assembly heating the printing medium is exposed to the outside. The cover 14 is formed on a portion of the upper side of the print head 10 with a height difference being created between the cover 14 and the heater assembly. Due to the height difference, a front end of the printing medium entering between the platen heater 20 and the print head 10, through the feed roller 30, is caught at an end of the cover 14 thereby causing a paper jam.

Accordingly, there is a need for an improved image forming apparatus having a print head which is operable so as to prevent a paper jam.

SUMMARY OF THE INVENTION

Exemplary embodiments of the present invention address at least the above problems and/or disadvantages and provide at least the advantages described below. Accordingly, an aspect of the present invention is to provide a print head assembly and an image apparatus having the same that is capable of preventing paper jam.

In order to achieve the above-described aspects of an exemplary embodiment of the present invention, there is provided a print head assembly comprising a print head for forming an image on a printing medium and is provided with a hinge axis. The print head assembly further includes a supporting unit for rotatably supporting the print head about the hinge axis and movably supporting the hinge axis. Also, the print head assembly provides a driving unit for driving the print head.

In order to achieve the above-described aspects of an exemplary embodiment of the present invention, there is provided an image forming apparatus comprising: a print head for forming an image on a conveyed printing medium comprising a hinge axis. The image forming apparatus further includes a transferring unit for transferring the printing medium to the print head. In addition, the image forming apparatus provides a supporting unit for rotatably supporting the print head about the hinge axis and movably supporting the hinge axis. Also, the image forming apparatus includes a driving unit for driving the print head.

According to one exemplary embodiment of the present invention, the print head comprises a guide plate and the supporting unit that comprises a supporting member having a first and second slit inserted with the hinge axis and the guide plate, respectively; and a cover formed at the supporting member. The first slit is arc shaped with reference to one external axis of the print head and the second slit is formed to be longer than the first slit. The one external axis is a center of the platen roller supporting the printing medium when the print head forms an image on the printing medium. The driving unit comprises a cam member for contacting the guide plate; a driving motor coupled to the cam member; and an elastic member for pressurizing the guide plate in a direction of the cam member. The elastic member has two ends, wherein one end is mounted at the cover and the other end mounted at the print head.

Other objects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWING FIGURES

Figure 2:
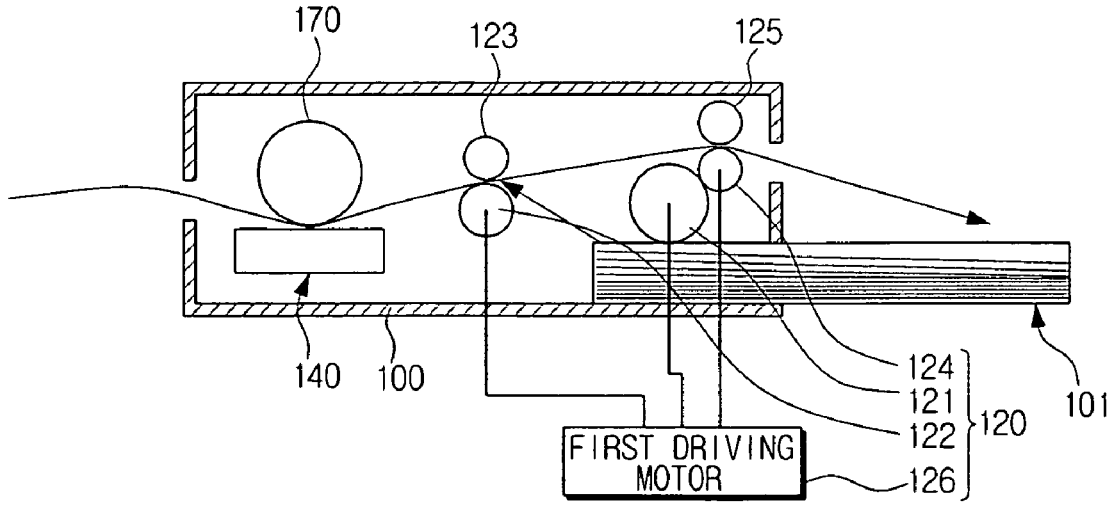
Figure 3:
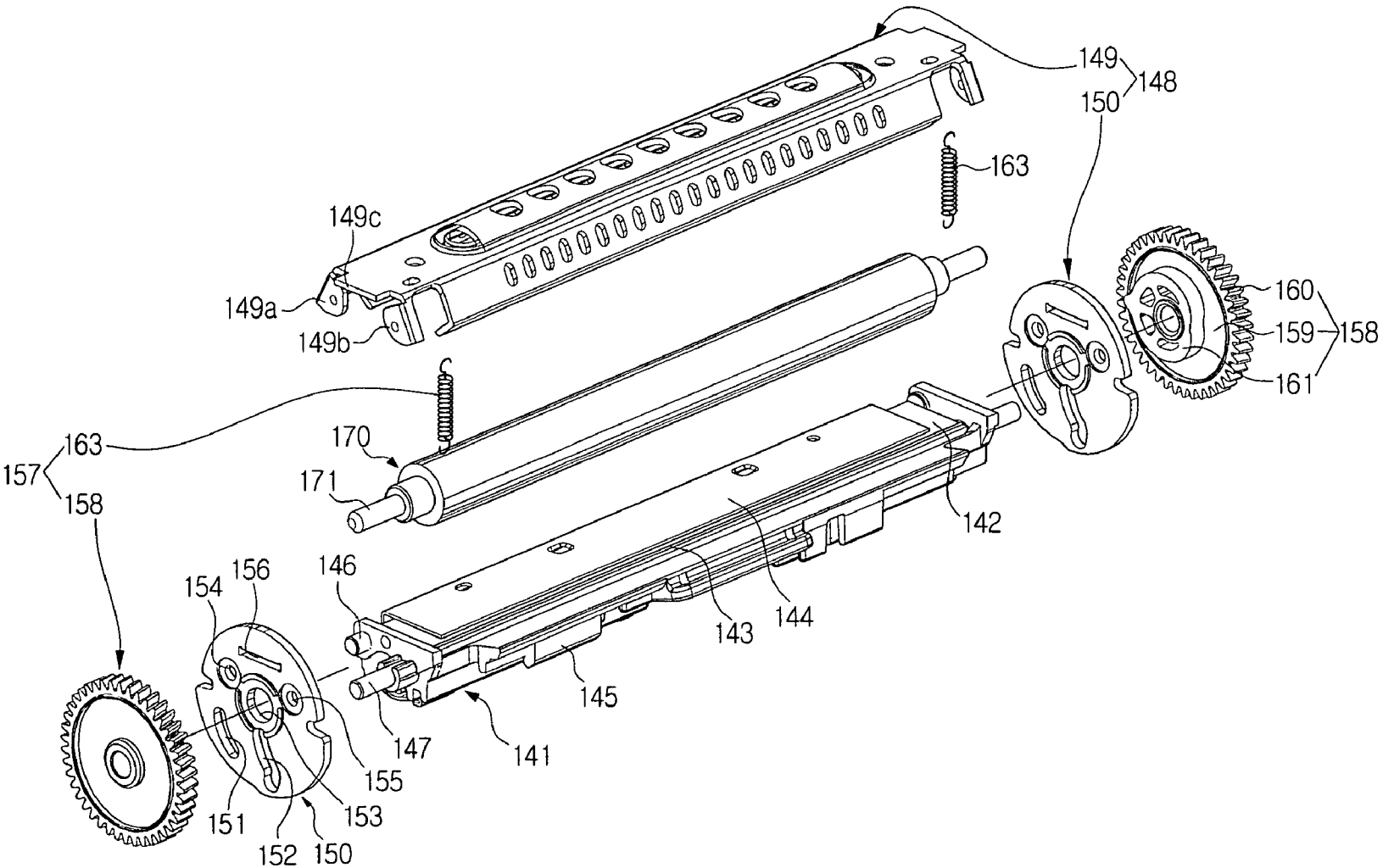
Figure 4:
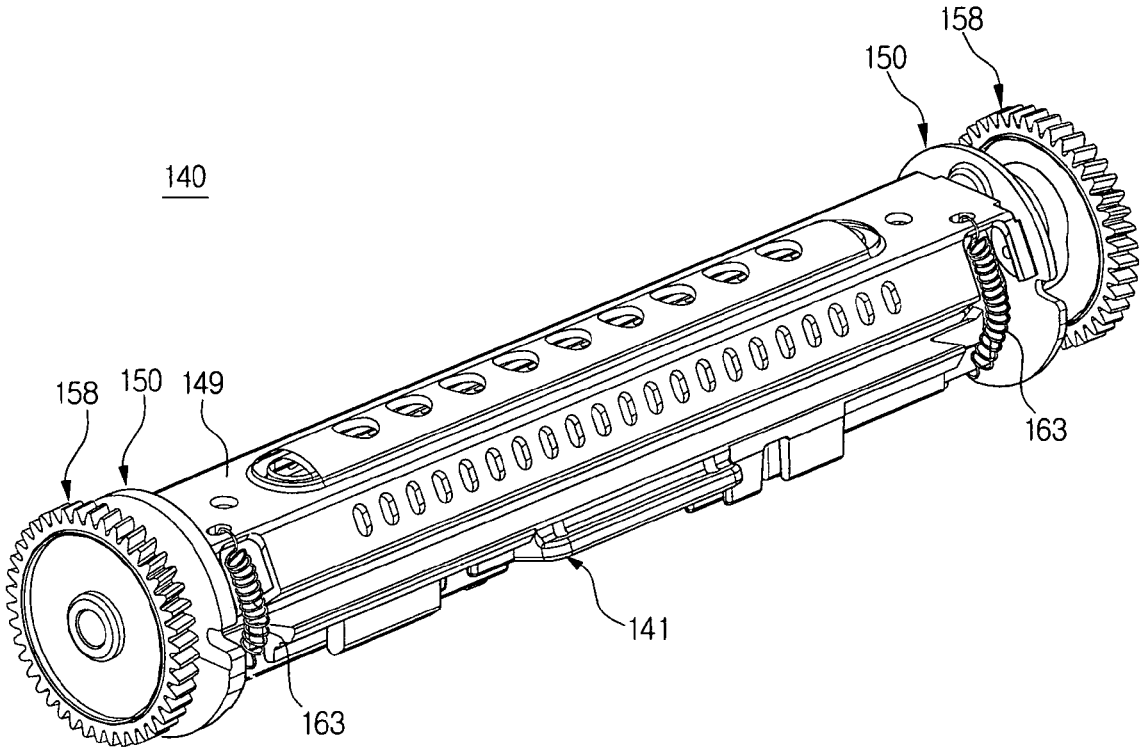
Figure 5:
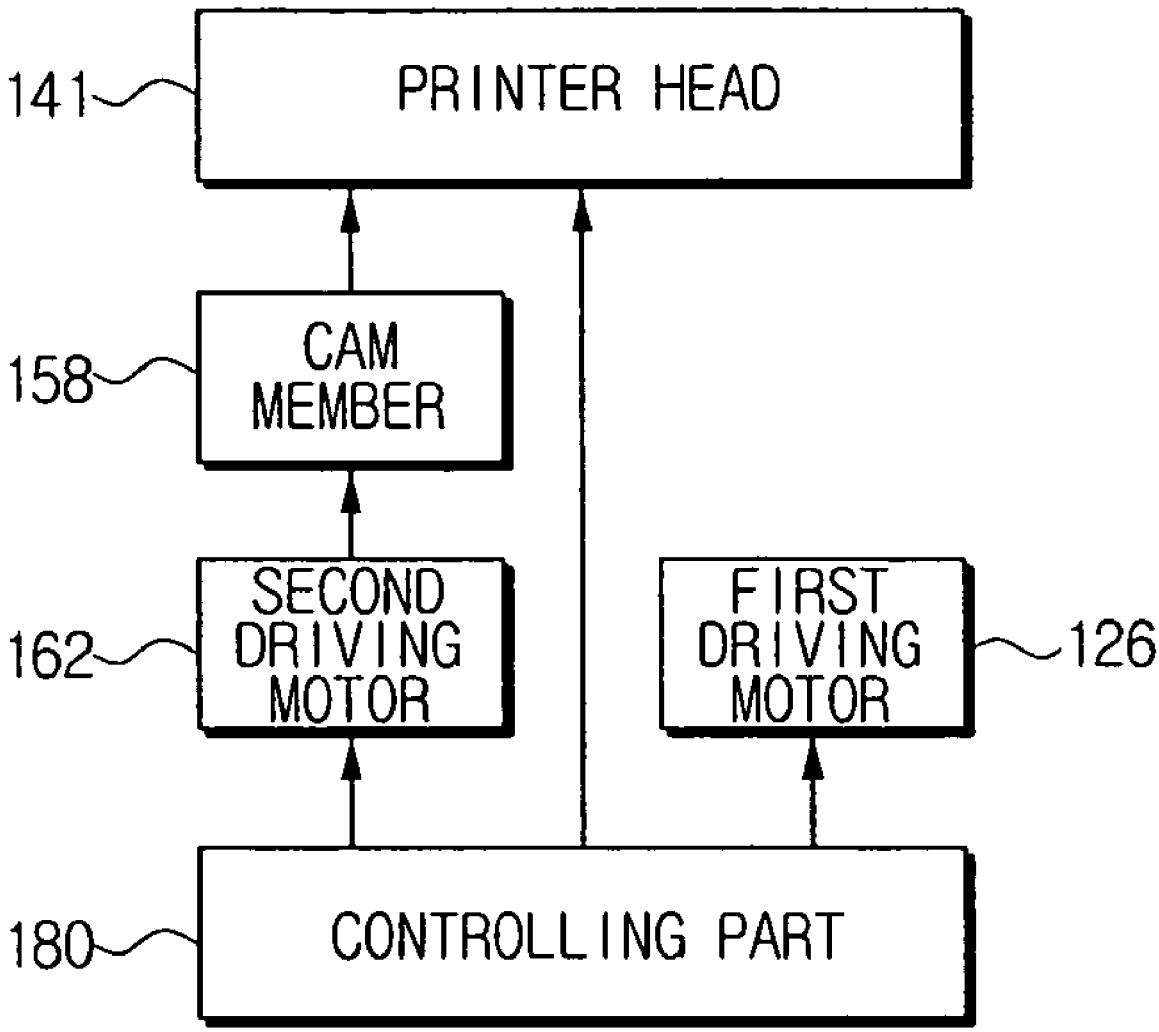
Figure 6A:
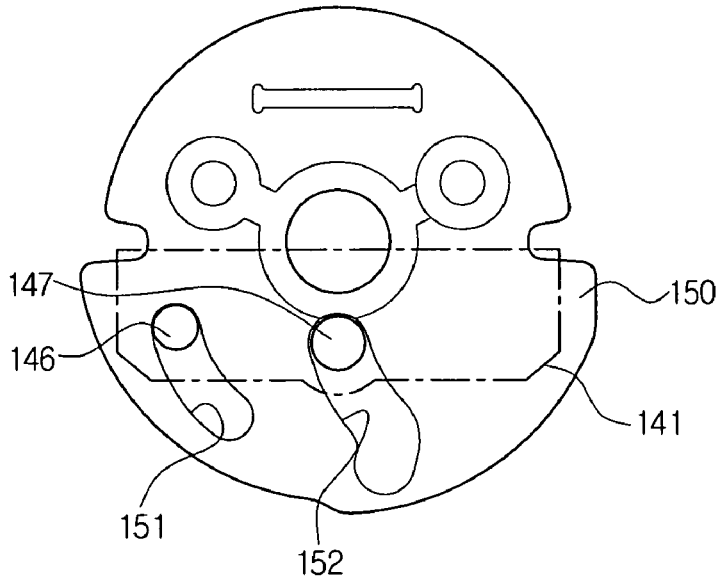
Figure 6B:
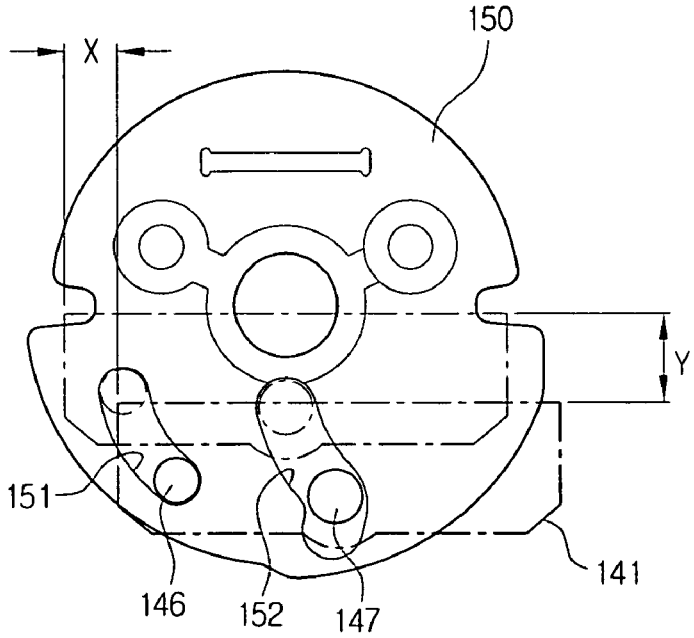
Figure 6C:
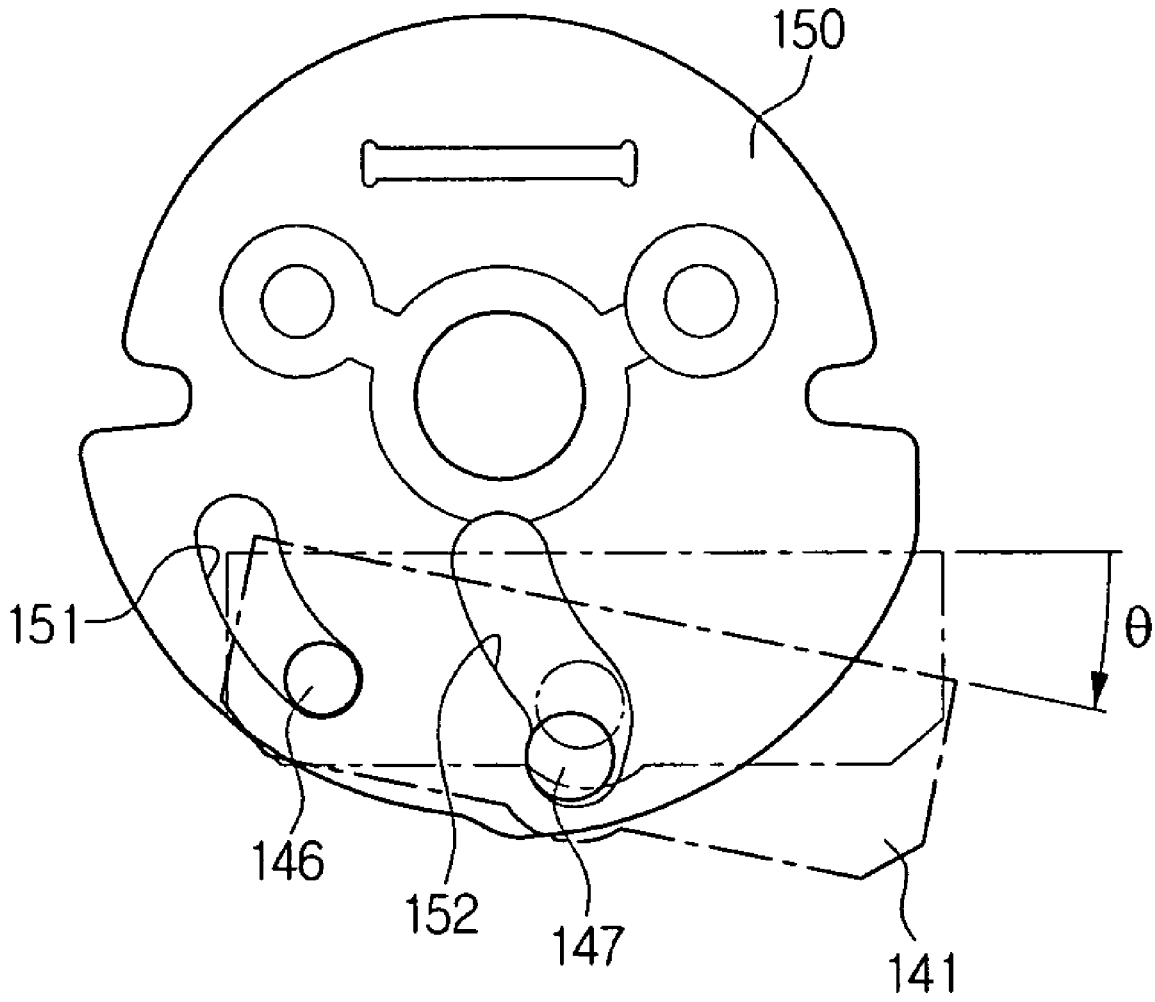
Figure 7A:
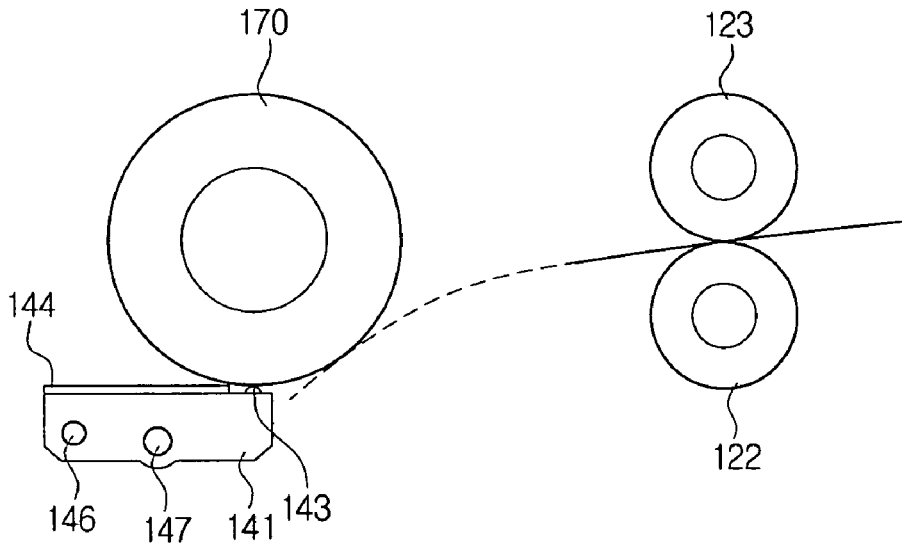
Figure 7B:
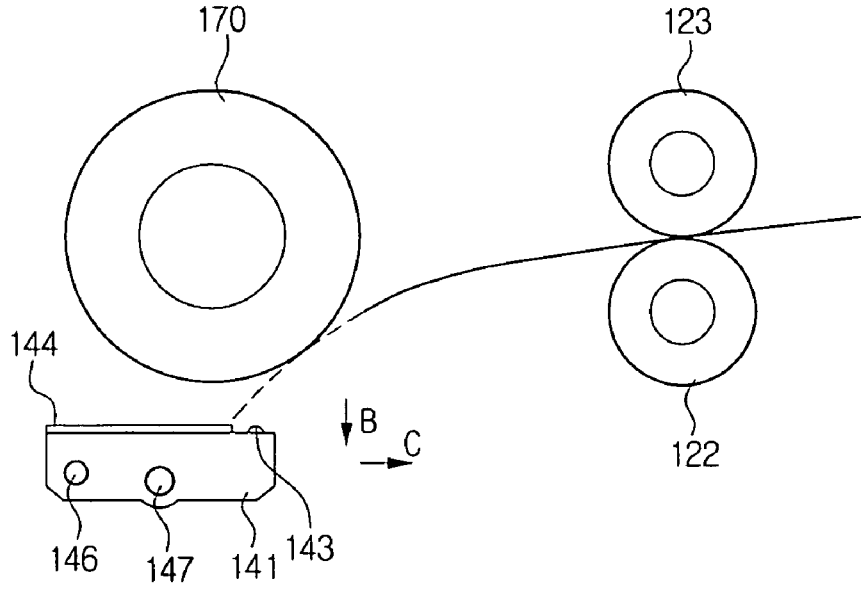
Figure 7C:
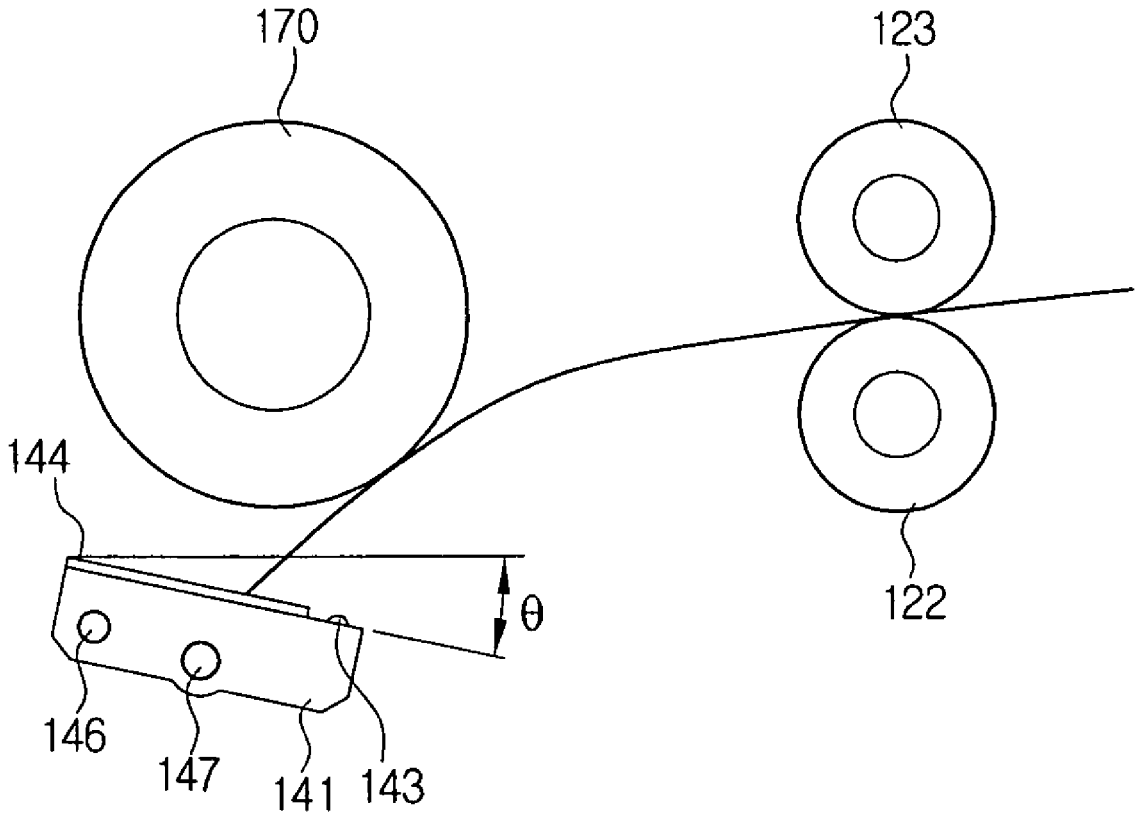

The above and other objects, features, and advantages of certain embodiments of the present invention will be more apparent from the following description taken in conjunction with the accompanying drawings, in which:

FIG. 1 is a view of a conventional image forming apparatus,

FIG. 2 is a sectional view of an image forming apparatus according to an exemplary embodiment of the present invention, FIG. 3 is an exploded perspective view of a print head assembly of FIG. 2, FIG. 4 is a combinational perspective view of the print head assembly of FIG. 3, FIG. 5 is a control block diagram of the image forming apparatus of the FIG. 1, FIGS. 6A through 6C are side views to explain movements of the print head assembly according to an exemplary embodiment of the present invention, and FIGS. 7A through 7C are provided to explain movements of the image forming apparatus according to an exemplary embodiment of the present invention.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention and are merely exemplary. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Referring to FIGS. 2 through 5, an image forming apparatus according to an exemplary embodiment of the present invention comprises a main body 100 provided with a paper supplying cassette 101. Further provided is a transferring unit 120 provided on the main body 100 for transferring a printing medium. In addition a head print assembly 140 is provided for forming an image on the printing medium transferred by the transferring unit 120. Also, a platen roller 170 is provided for supporting the printing medium when the print head assembly 140 forms an image on the printing medium. Lastly, a controlling part 180 is provided for controlling the transferring unit 120 and the print head assembly 140.

The transferring unit 120 comprises a pickup roller 121, a feed roller 122, a discharge roller 124, and a first driving motor 126. The pickup roller 121 picks up the printing medium loaded at the paper supplying cassette 101 in accordance with a request for printing.

The feed roller 122 transfers the printing medium picked up by the pickup roller 121 to the print head assembly 140 while rotating in contact with a first idle roller 123. Instead, the feed roller 122 may transfer the printing medium from the print head assembly 140 towards the discharge roller 124 while rotating in contact with a first idle roller 123. The discharge roller 124 discharges the printing medium having an image formed thereon to a discharge tray (not shown). The discharge roller 124 discharges the printing medium while rotating in contact with a second idle roller 125. The first driving motor 126 is connected to the pickup roller 121, the feed roller 122 and the discharge roller 124 to transmit power, and provide rotary power to the respective rollers 121, 122, and 124. The first driving motor 126 is connected to the controlling part 180 so as to communicate with the controlling part 180, and is controlled by the controlling part 180 to drive and rotate.

The print head assembly 140 comprises the print head provided with a heater assembly 143 having a plurality of heaters arranged in a row at predetermined intervals. The print head assembly 140 further includes heaters for forming the image on the transferred printing medium. Additionally, a supporting unit 148 is provided that movably supports the print head 141. Also provided is a diving unit 157 for moving the print head 141.

The print head 141 comprises a substrate 142, driving chip cover 144 and a radiation plate 145. The print head 141 is provided with the heater assembly 143. The driving chip cover 144 covers a driving chip unit (not shown) including a plurality of driving chips that each controls a respective group of heaters from the plurality of heaters. The radiation plate 145 radiates heat generated from the heater. The substrate 142 is provided with a circuit pattern so that each heater of the heater assembly 143 can be wired to the driving chips. The driving chip cover 144 is mounted at the radiation plate 145 to cover the protective layer in order to prevent vertical stripes from being generated on the printing medium that are caused by non-uniform protective layers (not shown). The radiation plate 145 is contactably attached to one side of each of the driving chip units and the substrate 142. The radiation plate 145 radiates heat generated from the heater and the driving chip. Both sides of the print head 141 are provided with the hinge axis 146 and the guide plate 147. More specifically, both sides of the radiation plate 145 are provided with the hinge axis 146 and the guide plate 147.

The supporting unit 148 comprises two supporting members 150 that are coupled with both sides of the print head 141 and the cover 149 fixed at the supporting members 150. The supporting unit 148 protects the print head 141 and the platen roller 170.

The supporting members 150 are provided with a first slit 151 being inserted with the hinge axis 146. Further, a second slit 152 is provided for being inserted with the guide plate 147. In addition, a supporting hole 153 is included for being inserted with an axis 171 of the platen roller 170 and rotatably support the platen roller 170 Two fixing holes 154 and 155 are provided for being inserted with the cover 149 and one fixing slit 156.

The first slit 151 is arc shaped with reference to the supporting hole 153. When the hinge axis 146 moves along the first slit 151, the print head 141 rotates with reference to the supporting hole 153, that is, an axis 171 of the platen roller 170.

When the hinge axis 146 moves along the first slit 151, the second slit 152 has the print head 141 revolving while not rotating on its own axis. The second slit 152 is formed to be longer than the first slit 151, such that the hinge axis 46 rotates along the first slit 151 and the guide plate 147 rotates about the hinge axis 146. According to an exemplary embodiment of the present invention, the print head 141 revolves while not rotating on its own axis, and rotates about the hinge axis 146. However, any other manner for moving the print head 141 so as to approach or be spaced away from the platen roller 70 or rotate on its own axis may be used. Such other manners may be achieved by varying the shapes of the first and second slits 151 and 152.

Both sides of the cover 149 are provided with coupling ribs 149*a* and 149*b* and a protrusion part 149*c* fixed at fixing holes 154 and 155 and a fixing slit 156 of the supporting member 150, respectively.

The driving unit 157 comprises a cam member 158 contacting the guide plate 147. The driving unit 157 further comprises the second driving motor 162 connected to the cam member 158 to transfer power. Additionally, the driving unit 157 comprises the elastic member 163 pressurizing the guide plate 147 towards the cam member 158.

The cam member 158 is rotatably provided at an axis 171 of the platen roller 170. The cam member 158 comprises a disc type main body 159 provided with a gear 160 connected to the second driving motor 162 on an outer circumference. The cam member 158 further comprises the protrusion part 161 protruding with a cam shape on a surface facing with the print head 141 of the disc type main body 159. When the protrusion part 161 contacts with the guide plate 147 and the cam member 158 rotates, the cam-shaped protrusion part 161 pressurizes the guide plate 147 and moves. According to an exemplary embodiment of the present invention, it is exemplified that the cam member 158 is supported by the axis 171 of the platen roller 170. However, the cam member 158 may be extended from the main body 100 and supported by a separately formed axis. It is exemplified to have two cam members 158, but it may alternatively use one cam member 158.

The second driving motor 162 is connected to the controlling part 180 so as to communicate via a signal with the controlling part 180 and is controlled to be rotated using the signal from the controlling part 180. If the second driving motor 162 rotates, the cam member 158 rotates and moves the guide plate 147 within the second slit 152. The hinge axis 146 and the guide plate 147 move along the first and second slits 151 and 152, respectively, and accordingly the print head 141 is moved.

There are two elastic members 163 needed, one end mounted at the cover 149 and the other end mounted at the print head 141, respectively. More specifically, the other end of the elastic member 163 is formed at the radiation plate 145. When the image is formed by the elastic member 163 or image formation is not performed, the print head is pressurized in a direction of the platen roller 170 and stays contacted with the platen roller 170. That is, the elastic member 163 pressurizes the guide plate 147 provided at the print head 141 in a direction of the cam member 158, such that the guide plate 147 is contacted with the cam member 158. According to an exemplary embodiment of the present invention, the elastic member 163 is comprised of two coil springs. However, the elastic member may alternatively be made of various elastic bodies such as rubber, regardless of the number.

The platen roller 170 is provided to face the heater and is rotatably supported by the supporting member 150 in an idle state. The platen roller 170 is rotated by the printing medium entering into the heater where the printing medium is heated and the image is formed, and supports the printing medium.

The controlling part 180 may employee a host, such as a main controller of the image formation apparatus or a computer, to control a series of image formation processes. In particular, the controlling part 180 controls the second driving motor 162 according to a request for printing and controls the print head 141 to move. Functions of the controlling part 180 will be described in more in detail below when operations according to an exemplary embodiment of the present invention are mentioned.

Hereinafter, operations according to an exemplary embodiment of the present invention will be described.

Referring to FIG. 3, FIG. 5, FIG. 6A and FIG. 7A, the heater assembly 143 of the print head 141 contacts the platen roller 170, when a request for printing is not made or at a point when the heater heats the printing medium and the image is formed. The guide plate 147 contact a bottom dead point of the cam member 158 and the elastic member 163 pressurizes the print head 146 towards the platen roller 170. Accordingly, the hinge axis 146 and the guide plate 147 stay contacted with upper sides of the first and second slits 151 and 152.

Referring to FIG. 3, FIG. 5, FIG. 6B and FIG. 7B, when the request for printing is received from a host, such as a computer, the controlling part 180 controls a first driving motor 126 to pick up the printing medium and transfer the printing medium to the print head 141. The controlling part 180 drives the second driving motor 162 to drive the cam member 158. The cam member 158 provides pressure to the guide plate 147 in a direction of 'B', that is, in a direction that the print head 141 is spaced away from the platen roller 170. The hinge axis 146 and the guide plate 147 move along the first and second slits 151 and 152 and a path of the print head 141 is decided by shapes of the first and second slits 151 and 152. As mentioned above, the first slit 151 is formed such that the hinge axis 146 is rotated about the platen roller 170, and an upper side of the second slit 152 is formed to rotate while the print head 141 does not rotate on its own axis. The print head 141 is moved in a direction of 'B', away from the platen roller 170, and in a direction of the printing medium, 'C'. That is, the print head 141 is moved in a direction of 'B', by 'Y' and in a direction of 'C' by 'X'. The guide plate 147 has not yet reached a top dead point of the cam member 158.

Referring to FIG. 3, FIG. 5, FIG. 6C and FIG. 7C, the second driving motor 162 keeps to rotate the cam member 158 and pressurize the guide plate 147 in a direction of 'B'. The hinge axis 146 reaches a lower side of the first slit 151 and no more moves. The guide plate 147 is rotated about the hinge axis 146 and the print head 141, as illustrated in FIG. 7C, rotates on its own axis with reference to the hinge axis 146, by a predetermined angle 'θ'. When the print head 141 is operating so as to rotate about the hinge axis 146, a front end of the printing medium reaches on an upper side of the driving chip cover 144. Accordingly, a paper jam is prevented which in a conventional image forming apparatus would have been caused by being caught at an end of the driving chip cover 144.

The printing medium enters into the print head 141 and the transferring unit 120 (refer to FIG. 2) further transfers the printing medium is the same direction. When the transferring unit 120 is operating so as to transfer the printing medium towards the print head assembly, the controlling part 180 controls the the first driving motor 126 to rotate in reverse and transfer the printing medium away from the print head assembly. The controlling part 180 controls the second driving motor 162 to rotate in reverse and allows the print head 141 to contact the platen roller 170. The controlling part 180 selectively drives a plurality of heaters prepared at the print head 141 and forms an image on the printing medium. After the completion of the image formation process, the printing medium is discharged to the discharge tray (not shown) by the discharge roller 124 (refer to FIG. 2).

As mentioned above, according to an exemplary embodiment of the present invention, the print head 141 is rotated about the hinge axis 146 and the hinge axis 146 is moved, such that a contact point of the printing medium is moved from the print head of a front end to an upper surface of the driving chip cover 144. Accordingly, paper jam is prevented which in a conventional image forming apparatus would have been caused by being caught at an end of the driving chip cover 144.

While the invention has been shown and described with reference to certain embodiments thereof, it will be understood by those skilled in the art that various changes in form and details may be made therein without departing from the spirit and scope of the invention as defined by the appended claims.

What is claimed is:

1. A print head assembly comprising:

a print head for forming an image on a printing medium comprising a hinge axis;

a supporting unit for rotatably supporting the print head about the hinge axis and for movably supporting the hinge axis; and a driving unit for driving the print head;

wherein the print head comprises a guide plate, and the supporting unit comprises a supporting member having a first and second slit inserted with the hinge axis and the guide plate, respectively, and a cover formed at the supporting member.

2. The print head assembly of claim 1, wherein the first slit is arc shaped with reference to one external axis of the print head.

3. The print head assembly of claim 2, wherein the second slit is formed to be longer than the first slit.

4. The print head assembly of claim 3, wherein the driving unit comprises a cam member for contacting the guide plate, a driving motor coupled to the cam member, and an elastic member pressurizing the guide plate in a direction of the cam member.

5. The print head assembly of claim 4, wherein the elastic member has two ends, wherein one end is mounted at the cover and the other end mounted at the print head.

6. An image forming apparatus comprising:

a print head for forming an image on a printing medium comprising a hinge axis;

a transferring unit for transferring the printing medium to the print head;

a supporting unit for rotatably supporting the print head about the hinge axis and for movably supporting the hinge axis; and a driving unit for driving the print head;

wherein the print head comprises a guide plate, and the supporting unit comprises a supporting member having a first and second slit inserted with the hinge axis and the guide plate, respectively, and a cover formed at the supporting member.

7. The image forming apparatus of claim 6, comprising a platen roller for supporting the printing medium when the print head forms an image on the printing medium, and wherein the first slit is arc shaped with reference to the platen roller.

8. The image forming apparatus of claim 7, wherein the second slit is formed to be longer than the first slit.

9. The image forming apparatus of claim 8, wherein the driving unit comprises a cam member for contacting the guide plate, a driving motor coupled to the cam member, and an elastic member pressurizing the guide plate in a direction of the cam member.

10. The image forming apparatus of claim 9, wherein the elastic member has two ends, wherein one end is mounted at the cover and the other end mounted at the print head

* * * * *